US006336392B1

(12) United States Patent
Fujita et al.

(10) Patent No.: US 6,336,392 B1
(45) Date of Patent: Jan. 8, 2002

(54) COMPRESSOR WHICH CAN BE EASILY AND EFFICIENTLY ASSEMBLED BY FACILITATING ADJUSTMENT OF AN AXIAL CLEARANCE OF A SHAFT

(75) Inventors: Masaaki Fujita; Keiji Shimizu, both of Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/437,220

(22) Filed: Nov. 10, 1999

(30) Foreign Application Priority Data

Nov. 11, 1998 (JP) ..... 10-320852
Dec. 9, 1998 (JP) ..... 10-350234

(51) Int. Cl.[7] ..... F01B 3/00
(52) U.S. Cl. ..... 92/71
(58) Field of Search ..... 92/71; 417/222.1, 417/269

(56) References Cited

U.S. PATENT DOCUMENTS

| | | | | |
|---|---|---|---|---|
| 1,971,033 A | | 8/1934 | Ferris et al. | |
| 2,962,970 A | | 12/1960 | Norlin | |
| 3,450,058 A | | 6/1969 | Stein | |
| 4,664,604 A | | 5/1987 | Terauchi | 417/222 |
| 4,842,488 A | | 6/1989 | Terauchi | 417/222 |
| 4,870,894 A | | 10/1989 | Toyoda et al. | |
| 4,948,343 A | | 8/1990 | Shimizu | |
| 5,259,736 A | * | 11/1993 | Terauchi | 417/222.1 |
| 5,741,122 A | | 4/1998 | Yokono et al. | 417/222.2 |
| 5,779,004 A | * | 7/1998 | Hoshino et al. | 92/71 X |
| 5,893,706 A | | 4/1999 | Kawaguchi et al. | 417/269 X |
| 5,915,928 A | * | 6/1999 | Murase et al. | 92/71 X |
| 5,953,980 A | * | 9/1999 | Ota et al. | 92/71 |

FOREIGN PATENT DOCUMENTS

| | | |
|---|---|---|
| EP | 0190013 | 1/1986 |
| EP | 0340024 | 4/1989 |
| EP | 0635640 | 7/1994 |
| GB | 2153922 | 1/1985 |
| JP | 60-135680 | 7/1985 |

* cited by examiner

*Primary Examiner*—John E. Ryznic
(74) *Attorney, Agent, or Firm*—Baker Botts L.L.P.

(57) ABSTRACT

In a compressor in which a compression operation is obtained in accordance with a rotation of a shaft rotatable supported by a cylinder block and a front housing coupled to each other, an axial urging arrangement and a thrust bearing are interposed between an axial end surface of the shaft and the cylinder block. The axial urging arrangement and the thrust bearing are arranged in series. The axial urging arrangement has a compression coil spring for urging the shaft in its axial direction.

11 Claims, 8 Drawing Sheets

COMPRESSOR WHICH CAN BE EASILY AND EFFICIENTLY ASSEMBLED BY FACILITATING ADJUSTMENT OF AN AXIAL CLEARANCE OF A SHAFT

BACKGROUND OF THE INVENTION

This invention relates to a compressor for use in an automobile air conditioner and, in particular, to an improvement of a bearing structure supporting an end of a shaft.

As a typical compressor of the type, there is known a swash-plate compressor having a structure illustrated in FIG. 1. The swash-plate compressor comprises a front housing 1, a cylinder block 2', and a rear housing (cylinder head) 3 assembled together by the use of a through bolt 4 penetrating through the front housing 1 and the cylinder block 2' to be received in the rear housing 3. Specifically, the front housing 1 is coupled to a front end of the cylinder block 2' while the rear housing 3 is coupled to a rear end of the cylinder block 2' with a valve plate 9 interposed therebetween. A combination of the front housing 1 and the cylinder block 2' defines a crank chamber 15 in which a shaft (drive shaft) 5' extends in an axial direction. The shaft 5' is rotatably supported by a pair of bearings 18 and 19 attached to the cylinder block 2' and the front housing 1, respectively. Upon assembling, the shaft 5' is inserted through the front housing 1 towards the rear housing 3 until one end of the shaft 5' is received in a receptacle portion of the cylinder block 2'. At this time, the one end of the shaft 5' is pushed back by an adjusting screw 22 disposed in the cylinder block 2' towards the front housing 1 to leave an axial clearance. Thus, the adjusting screw 22 serves to adjust the axial clearance of the shaft 5'. The cylinder block 2' is provided with a plurality of cylinder bores 8 formed at positions surrounding the shaft 5' to receive a plurality of pistons 7 inserted therein, respectively.

Within the crank chamber 15, a swash plate 6 to coupled to the shaft 5'. Specifically, the shaft 5' is inserted into a through hole formed in the swash plate 6 to fix the swash plate 6 around the shaft 5'. Between the swash plate 6 and the front housing 1, a thrust bearing 20 having elasticity is interposed to urge the swash plate 6 towards the rear housing 3. The swash plate 6 has an outer peripheral portion kept in contact with a plurality of semispherical shoes 23 as a coupling mechanism. Each of the shoes 23 has an outer semispherical surface engaged with a ball bearing surface of each of the pistons 7. Following the rotation of the shaft 5', each of the pistons 7 coupled through the shoe 23 to the swash plate 6 performs reciprocal movement within the cylinder bore 8.

The rear housing 3 has an inner space divided into a suction chamber 10 and a discharge chamber 11. The valve plate 9 is provided with a suction port 12 and a discharge port 13 formed in an area corresponding to each cylinder bore 8. A compression space is formed between the valve plate 9 and each of the pistons 7. Through the suction port 12 and the discharge port 13, the compression space communicates with the suction chamber 10 and the discharge chamber 11, respectively. Each suction port 12 is provided with a valve (not shown) for opening and closing the suction port 12 in response to the reciprocal movement of the piston 7. Likewise, each discharge port 13 is provided with a valve (not shown) for opening and closing the discharge port 13 under the restraint of a retainer 14 in response to the reciprocal movement of the piston 7.

The swash-plate compressor described above is of a fixed displacement type. When the swash plate 6 is rotated following the rotation of the shaft 5', the rotation is transmitted through the shoe 23 to each piston 7 so that each piston 7 performs the reciprocal movement within the cylinder bore 8. As a consequence, a refrigerant gas is sucked from the suction chamber 10 through the suction port 12 into the compression chamber. The refrigerant gas is compressed within the compression chamber and then discharged through the discharge port 13 to the discharge chamber 11.

In the swash-plate compressor described above, the adjusting screw for adjusting the axial clearance of the shaft is used. The use of such adjusting screw is disclosed in Japanese Utility Model Publication (JP-Y) No. 3-41101 (41101/1991) which is directed to a variable-displacement compressor.

In the swash-plate compressor described above, the front housing, the cylinder block, and the rear housing are fixed by the use of the through bolt. Alternatively, the front housing and the cylinder block are fixed by a first through bolt while the cylinder block and the rear housing are fixed by a second through bolt. In either event, an assembling process is carried out in the following manner. At first, the shaft, the swash plate, and the piston are coupled to the front housing and the cylinder block. In order to adjust the axial clearance of the shaft, the front housing and the cylinder block are temporarily assembled with the above-mentioned components coupled thereto. An axial end surface at the one end of the shaft is pressed by the adjusting screw to adjust the axial clearance. Thereafter, in order to prevent the adjusting screw from being loosened, an anti-loosening procedure is taken, for example, a head of the adjusting screw is collapsed or caulked. After the other components including the valve plate and the rear housing are coupled, final or permanent assembling is carried out. Thus, the assembling process requires two separate stages including the temporary assembling and the final assembling between which the adjustment of axial clearance and the anti-loosening procedure are carried out. Thus, the assembling process is complicated, time-consuming, and inefficient.

SUMMARY OF THE INVENTION

It is an object of the present invention to provide a compressor which is capable of easily adjusting an axial clearance of a shaft and which can be assembled by a simple process with excellent efficiency.

Other objects of the present invention will become clear as the description proceeds.

According to an aspect of the present invention, there is provided a compressor which comprises a cylinder block, a front housing coupled to the cylinder block, a shaft extended in an axial direction and rotatably supported by the cylinder block and the front housing, the shaft being rotated to cause a compressing operation of the compressor, an axial urging arrangement having a compression coil spring for urging the shaft in the axial direction, and a thrust bearing, the axial urging arrangement and the thrust bearing being arranged in series and interposed between an axial end surface of the shaft and the cylinder block.

According to another aspect of the present invention, there is provided a compressor which comprises a cylinder block having a receptacle portion, a shaft extending in an axial direction and having one end inserted into the receptacle portion, a collar fitted over the one end of the shaft, the collar being unrotatable and axially movable with respect to the shaft, and an elastic member arranged inside to elastically urge an axial end surface of the shaft.

According to still another aspect of the present invention, there is provided a compressor which comprises a cylinder block having a plurality of cylinders, a plurality of single-headed pistons adapted to perform reciprocal movement within the cylinders, respectively, a front housing coupled to the cylinder block, a shaft supported by the cylinder block and the front housing, a swash plate integrally fixed to the shaft, a plurality of shoes each of which is interposed between the swash plate and each of the pistons, a pair of radial bearings arranged in the front housing and the cylinder block, respectively, to radially support the shaft, a thrust race bearing arranged between the front housing and the swash plate, a spring for urging an axial end surface of the shaft towards the front housing, and an interposed member interposed between the spring and the axial end surface of the shaft, the cylinder block having a stepped portion which serves to receive the spring abutted thereto so that the shaft is axially supported.

DESCRIPTION OF THE PREFERRED EMBODIMENT

Figure 1:
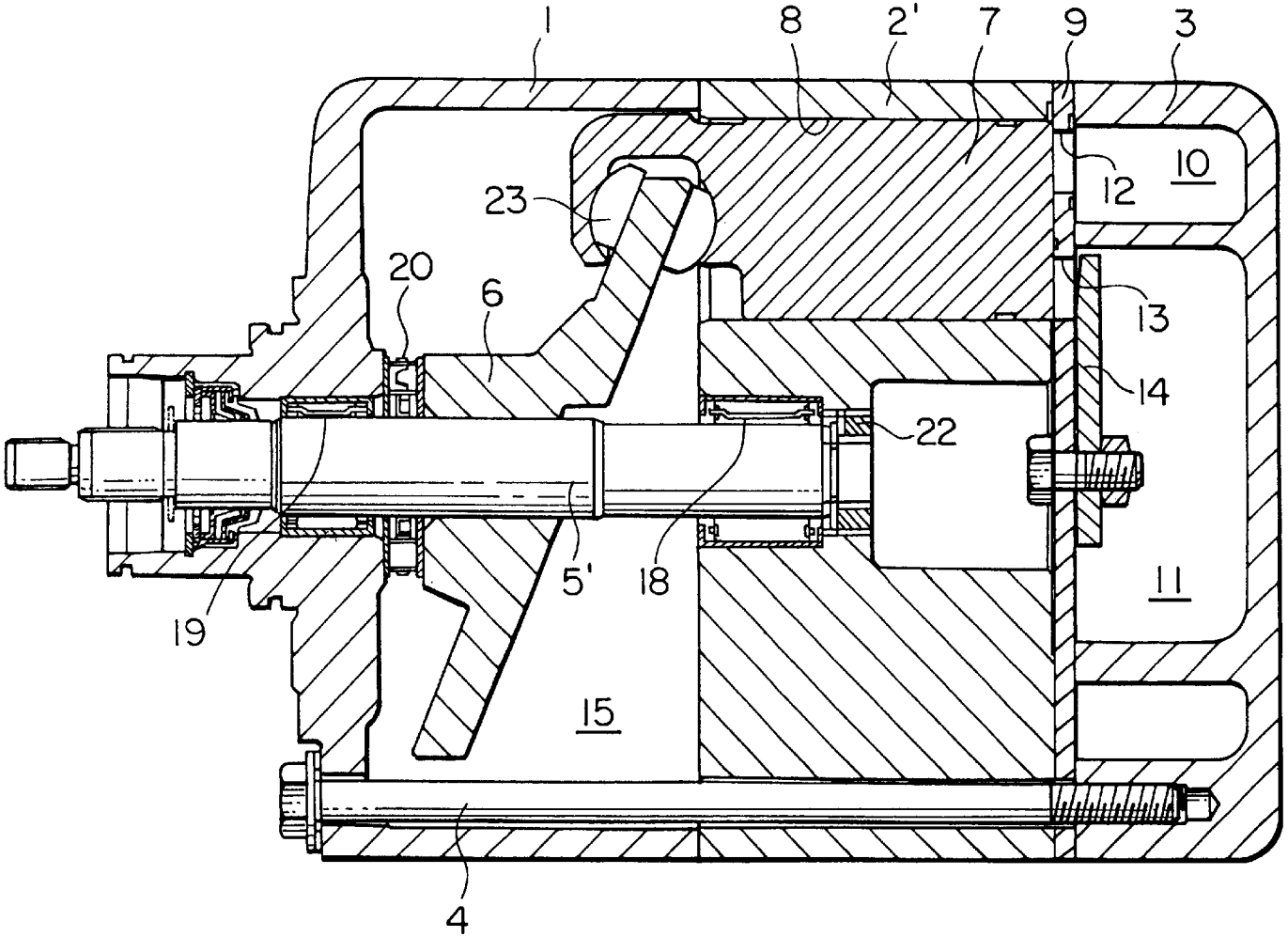
FIG. 1 PRIOR ART
FIG. 1 is a vertical sectional view of a conventional swash-plate compressor.

Now, description will be made about several preferred embodiments of this invention with reference to the drawing.

At first referring to FIGS. 2 through 4, a swash-plate compressor according to a first embodiment of this invention will be described. The swash-plate compressor is basically similar in structure to the conventional swash-plate compressor described in conjunction with FIG. 1. Similar parts are designated by like reference numerals and will not be described any longer.

Figure 2:
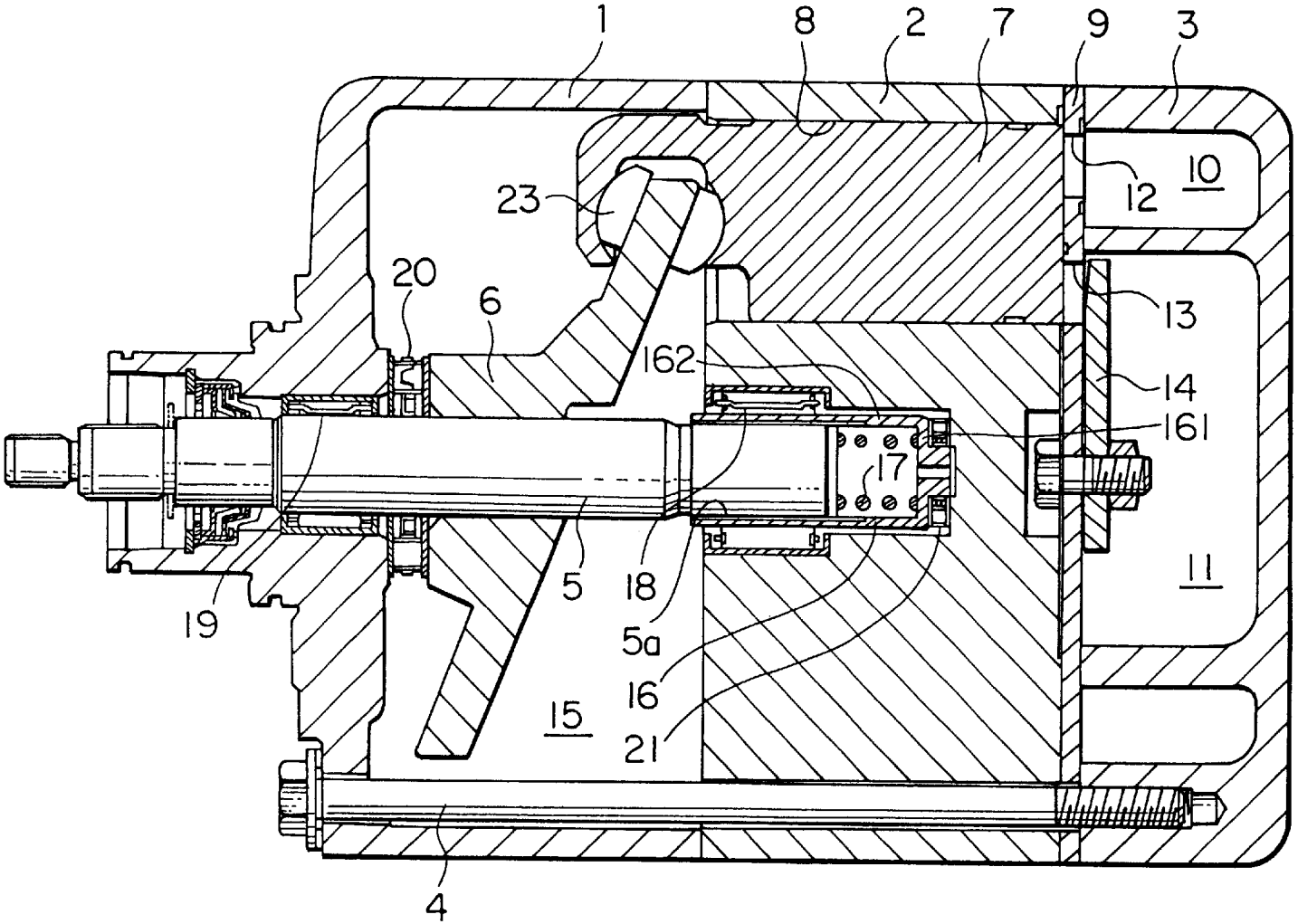
FIG. 2 is a vertical sectional view of a swash-plate compressor according to a first embodiment of this invention.
Figure 3:
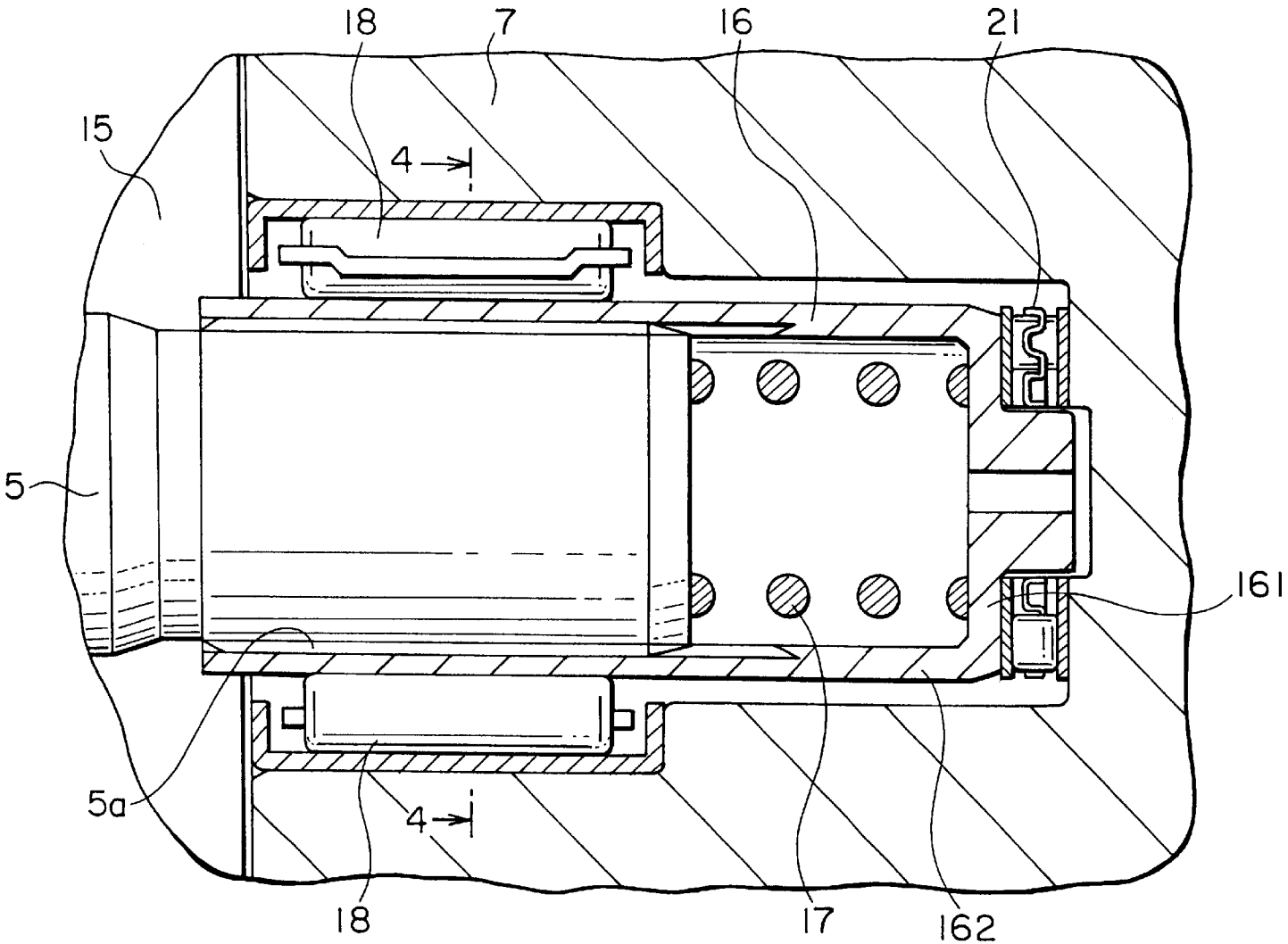
FIG. 3 is an enlarged sectional view showing a characteristic part of the swash-plate compressor illustrated in FIG. 2.

As Illustrated in FIGS. 2 and 3, a combination of a front housing 1 and a cylinder block 2 defines a crank chamber 15. Within the crank chamber 15, a shaft 5 extends in an axial direction with a swash plate 6 coupled thereto. Specifically, the shaft 5 is inserted into a through hole formed in the swash plate 6 to fix the swash plate 6 around the shaft 5. The shaft 5 has one end inserted into a receptacle portion of the cylinder block 2. The one end of the shaft 5 is covered with a collar 16 integrally fitted to the shaft 5 to be rotatable around the axial direction and movable in the axial direction. The collar 16 has an elastic member 17 comprising a compression coil spring and arranged inside to elastically urge an axial end surface of the one end of the shaft 5.

Between the receptacle portion of the cylinder block 2 and the collar 16, a thrust bearing 21 and a radial bearing 18 are interposed. The thrust bearing 21 and the radial bearing 18 are brought into contact with an axial end surface of the collar 16 and a side surface of the collar 16, respectively. A combination of the collar 16 and the elastic member 17 forms an axial urging arrangement for urging the shaft 5 in one direction towards the front housing 1.

The collar 16 comprises an end plate portion 161 interposed between the thrust bearing 21 and the elastic member 17, and a cylindrical portion 162 coupled to the end plate portion 161 and fitted to the shaft 5 to be unrotatable and axially movable. The cylindrical portion 162 is supported by the cylinder block 2 through the radial bearing 18.

Figure 4A:
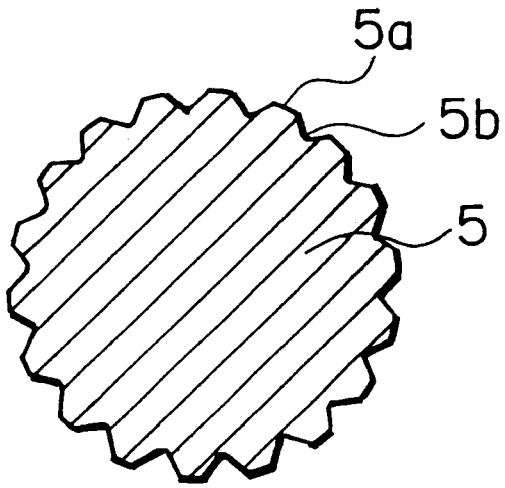
FIGS. 4A and 4B are sectional views taken along a line 4—4 in FIG. 3 and showing a shaft and a collar, respectively.
Figure 4B:
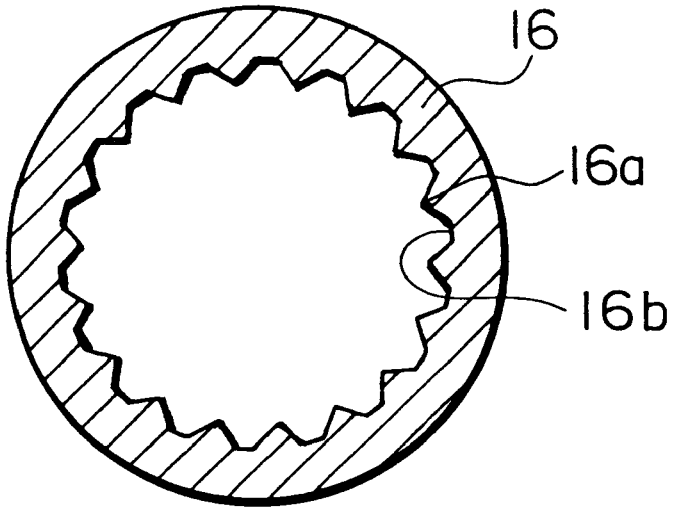

Referring to FIG. 4A, the one end of the shaft 5 has an outer peripheral surface provided with ridges 5*a* and grooves 5*b* extending in the axial direction and exhibits a serrated circular section in a plane perpendicular to the axial direction. Referring to FIG. 4B, the collar 16 has an inner peripheral surface provided with ridges 16*a* and grooves 16*b* extending in the axial direction and exhibits a serrated annular section in the plane perpendicular to the axial direction. With this structure, the inner peripheral surface of the collar 16 is fitted to and engaged with the outer peripheral surface of the shaft 5 through a serration engagement in which the ridges 5*a* and the grooves 5*b* of the outer peripheral surface of the shaft 5 are mated with the grooves 16*b* and the ridges 16*a* of the inner peripheral surface of the collar 16, respectively. In this state, the shaft 5 and the collar 16 are integrally coupled to each other to be rotatable around the axial direction and movable in the axial direction.

In the above-mentioned manner, the shaft 5 is supported by the cylinder block 2 and the front housing 1 coupled thereto. The rotation of the shaft 5 is converted through the swash plate 6 into the reciprocal movement of a piston 7 to cause a compressing operation of the compressor. In the compressor, the axial urging arrangement having the compression coil spring and the thrust bearing 21 are arranged in series and interposed between the axial end surface of the shaft 5 and the cylinder block 2.

The compressor having the above-mentioned structure is assembled in the following manner. At first, the outer peripheral surface of the one end of the shaft 5 is fitted and fixed to the inner peripheral surface of the collar 16 with the elastic member 17 arranged inside. Thus, the one end of the shaft 5 is coupled to and covered with the collar 16. Then, the shaft 5, the swash plate 6, and the piston 7 are assembled to the front housing 1 and the cylinder block 2. At this time, the elastic member 17 arranged inside the collar 16 urges the axial end surface of the shaft 5 in the axial direction towards the front housing 1 with appropriate force. Thus, adjustment of an axial clearance of the shaft 5 is easily achieved. This allows continuous and smooth assembling of the other components including the valve plate 9 and the rear housing 3.

It is noted here that, in the conventional compressor described in conjunction with FIG. 1, the axial end surface of the shaft 5' is pressed by the adjusting screw 22 to adjust the axial clearance and, thereafter, the anti-loosening procedure is taken to prevent the adjusting screw 22 from being loosened. According to the first embodiment of this invention, such complicated and time-consuming steps are unnecessary and the compressor can be assembled by a streamlined process which is simple, time-saving, and efficient.

In addition, in the compressor according to the first embodiment, the elastic member 17 for urging the axial end surface of the shaft 5 is arranged inside the collar 16 so that no frictional movement between the elastic member 17 and the shaft 5 is caused. Therefore, the elastic member 17 is suppressed in aging and has an excellent durability. As compared with the conventional compressor discussed with reference to FIG. 1, the compressor of the first embodiment is remarkably improved in durability and mechanical stability.

Figure 5:
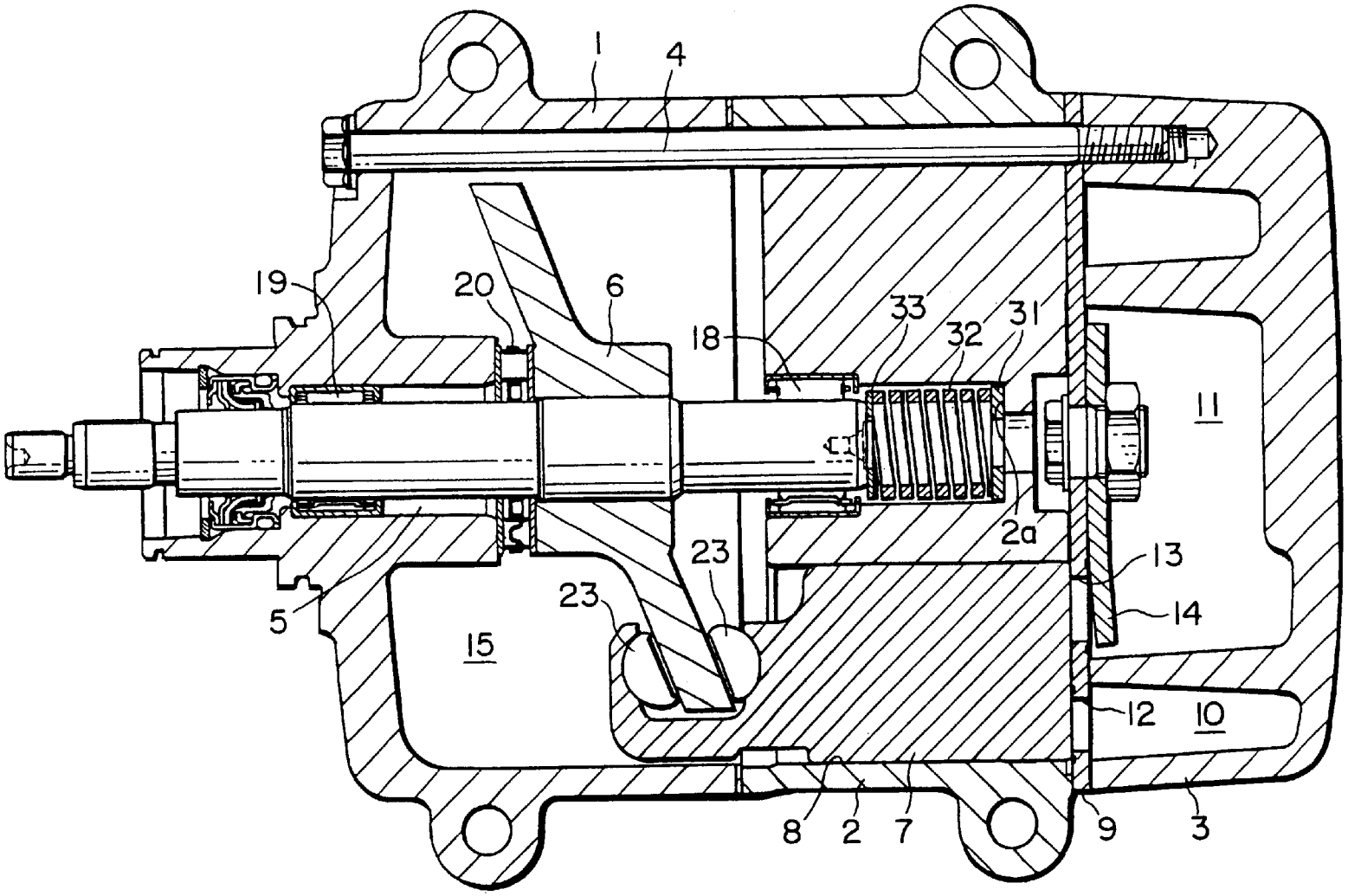
FIG. 5 is a vertical sectional view of a swash-plate compressor according to a second embodiment of this invention.
Figure 6:
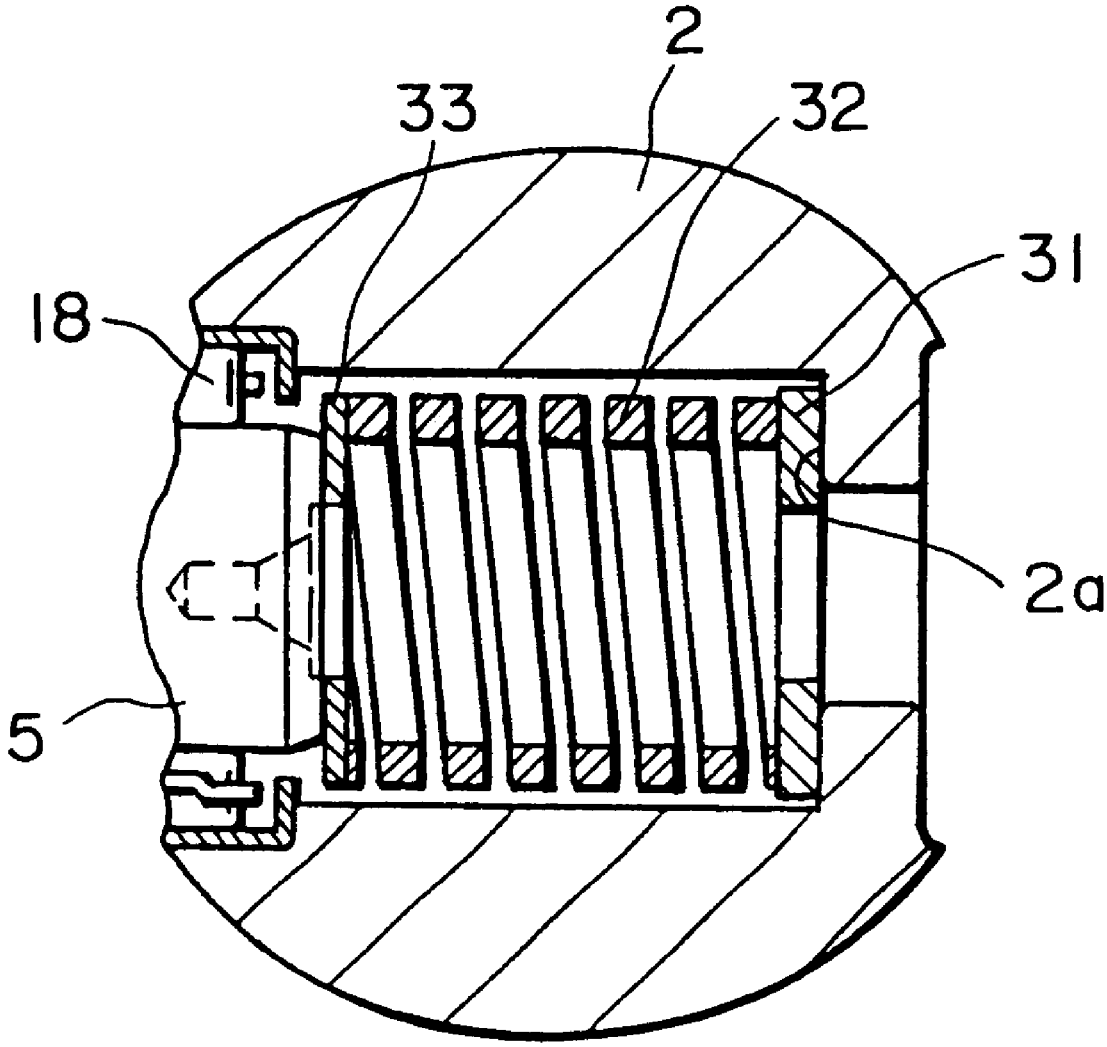
FIG. 6 is an enlarged sectional view of a characteristic part of the swash-plate compressor illustrated in FIG. 5.

Referring to FIGS. 5 and 6, a swash-plate compressor according to a second embodiment of this invention is similar in structure to the first embodiment. Similar parts are designated by like reference numerals and will not be described any longer.

In the swash-plate compressor of the second embodiment also, the shaft 5 is supported by the cylinder block 2 and the front housing 1 coupled thereto. The rotation of the shaft 5 to converted through the swash plate 6 into the reciprocal movement of the piston 7 to cause the compressing operation of the compressor. Between the axial end surface of the shaft 5 and a stepped portion 2*a* of the cylinder block 2, a shim 31, a compression coil spring 32, and a screw plate 33 are interposed and arranged in series in the axial direction. The stepped portion 2*a* serves to receive the compression coil spring 32 through the shim 31 in the axial direction. Relative to the cylinder block 2, the screw plate 33 is movable in the axial direction but is inhibited from rotation. The screw plate 33 is located between the shaft 5 and the compression coil spring 32 and serves as a thrust bearing receiving the axial end surface of the shaft 5 or as an adjusting plate for suppressing the wear. A combination of the shim 31 and the compression coil spring 32 will be called an axial urging arrangement for urging the shaft 5 in the axial direction.

The thrust bearing 20 is a thrust race bearing for urging the swash plate 6 in a direction opposite to an urging direction by the compression coil spring 32. The urging force of the compression coil spring 32, i.e., the load must be greater than an axial load produced by an electromagnetic clutch (not shown) which is for connecting or disconnecting a driving source (not shown) with the shaft 5.

Figure 7:
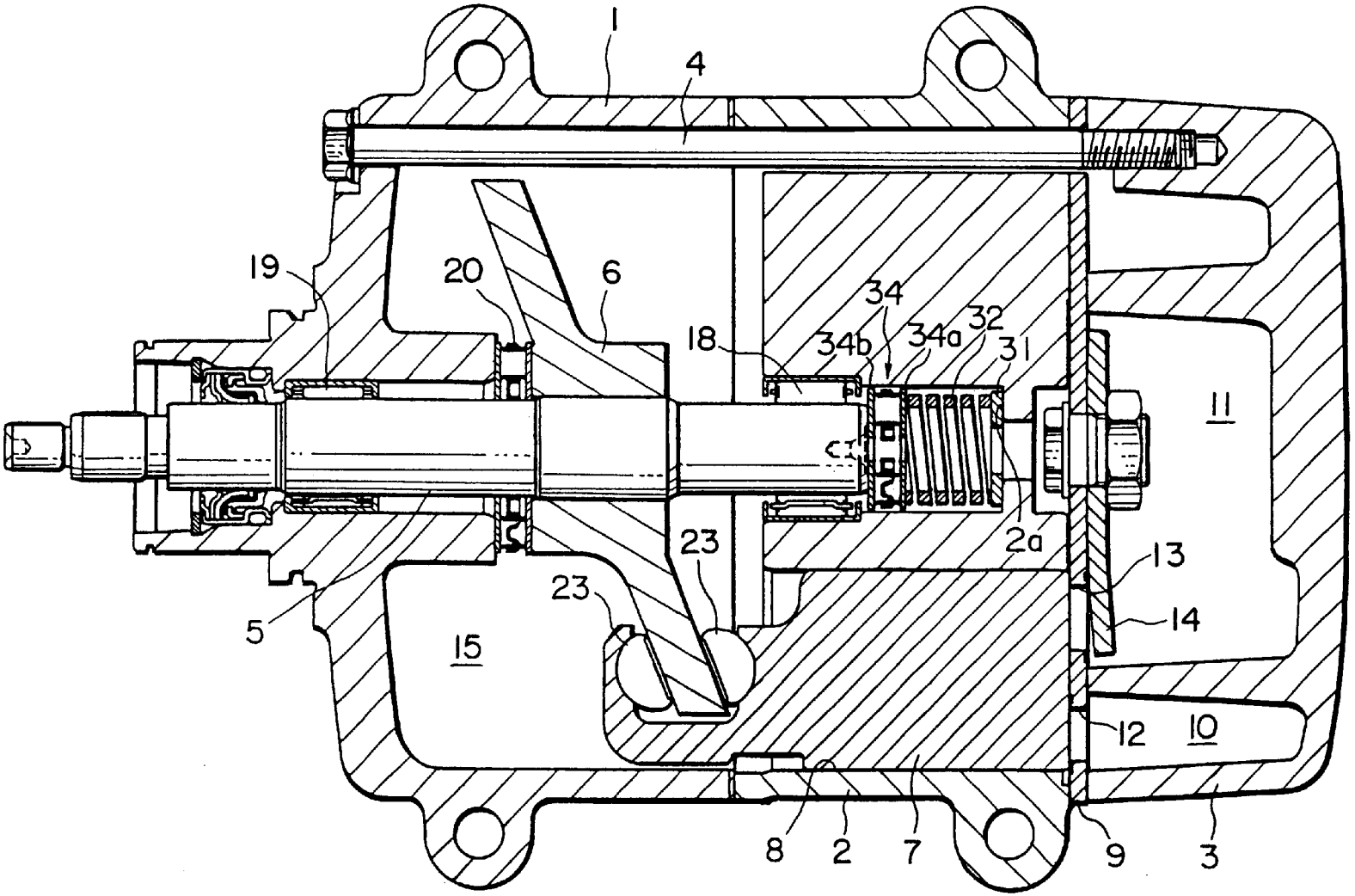
FIG. 7 is a vertical sectional view of a swash-plate compressor according to a third embodiment of this invention.
Figure 8:
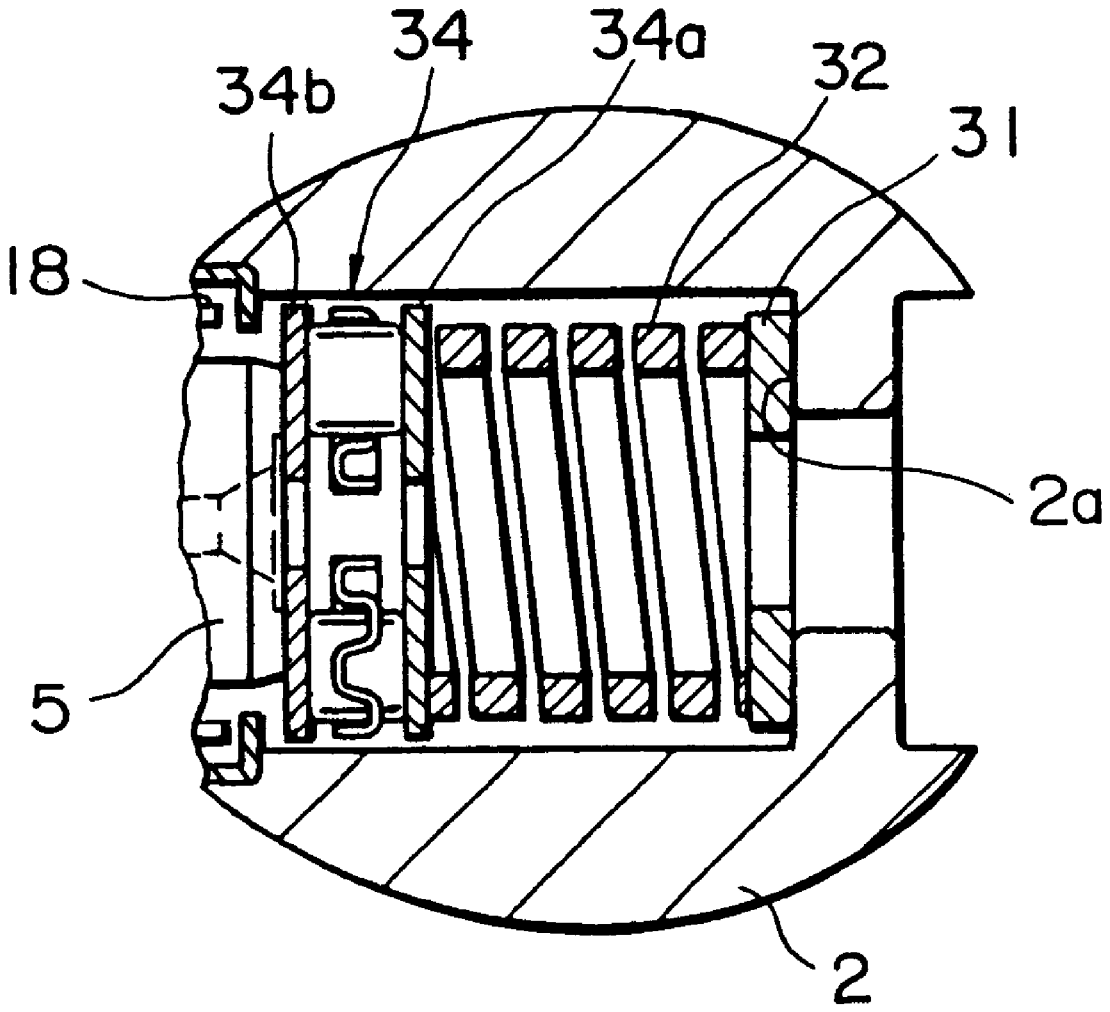
FIG. 8 is an enlarged sectional view of a characteristic part of the swash-plate compressor illustrated in FIG. 7.

Referring to FIGS. 7 and 8, a swash-plate compressor according to a third embodiment of this invention is similar in structure to the first embodiment. Similar parts are designated by like reference numerals and will not be described any longer.

In the swash-plate compressor of the third embodiment also, the shaft 5 is supported by the cylinder block 2 and the front housing 1 coupled thereto. The rotation of the shaft 5 is converted through the swash plate 6 into the reciprocal movement of the piston 7 to cause the compressing operation of the compressor. Between the axial end surface of the shaft 5 and the cylinder block 2, the shim 31, the compression coil spring 32, and a thrust race bearing 34 are interposed and arranged in series in the axial direction. The thrust race bearing 34 is located between the shaft 5 and the compression coil spring 32 and receives the axial end surface of the shaft 5. A combination of the shim 31 and the compression coil spring 32 will be called an axial urging arrangement for urging the shaft 5 in the axial direction.

The thrust bearing 20 is a thrust race bearing for urging the swash plate 6 in a direction opposite to the urging direction by the compression coil spring 32. The urging force of the compression coil spring 32, i.e., the load must be greater than an axial load produced by an electromagnetic clutch (not shown) for driving the rotation of the shaft 5 when it is energized.

The thrust race bearing 34 has a spring-side race 34*a* and a shaft-side race 34*b*. Preferably, the spring-side race 34*a* is movable in the axial direction but is inhibited from rotation relative to the cylinder block 2. The shaft-side race 34*b* is movable in the axial direction and rotatable relative to the cylinder block 2.

As described above, when the compressor is assembled, the axial urging arrangement urges the axial end surface of the shaft in the axial direction towards the front housing with appropriate force. Therefore, the adjustment of axial clearance of the shaft is easily carried out without using the adjusting screw. Therefore, the subsequent assembling steps are continuously and smoothly carried out. Thus, a whole of the assembling process is carried out in a streamlined fashion without requiring complicated operation and long time. Therefore, the efficiency of assembling is improved. Since the adjusting screw is unnecessary, no anti-loosening procedure is required to prevent the loosening of the adjusting screw after adjustment of the axial clearance which is essential in the conventional compressor. Thus, the assembling process is further simplified.

While the present invention has thus far been described in connection with a few embodiments thereof, it will readily be possible for those skilled in the art to put this invention into practice in various other manners. For example, although the swash-plate compressor is of a fixed-displacement type in the foregoing description, this invention is also applicable to a variable-displacement type.

What is claimed is:

1. A compressor comprising:

a cylinder block;

a front housing coupled to said cylinder block;

a shaft extended in an axial direction and rotatably supported by said cylinder block and said front housing, said shaft being rotated to cause a compressing operation of said compressor;

an axial urging arrangement having a compression coil spring for urging said shaft in said axial direction; and a thrust bearing;

said axial urging arrangement and said thrust bearing being arranged in series and interposed between an axial end surface of said shaft and said cylinder block.

2. A compressor as claimed in claim 1, wherein said thrust bearing is interposed between said axial urging arrangement and said cylinder block.

3. A compressor as claimed in claim 2, wherein said axial urging arrangement comprises:

an end plate portion interposed between said thrust bearing and said compression coil spring; and a cylindrical portion coupled to said end plate portion and fitted to the shaft to be unrotatable and axially movable;

said compressor further comprising a radial bearing for rotatably supporting said cylindrical portion against said cylinder block.

4. A compressor as claimed in claim 1, wherein said thrust bearing is interposed between said axial end of the shaft and said axial urging arrangement.

5. A compressor as claimed in claim 1, further comprising another thrust bearing for urging said shaft against said axial urging arrangement in said axial direction.

6. A compressor comprising:

a cylinder block having a receptacle portion;

a shaft extending in an axial direction and having one end inserted into said receptacle portion;

a collar fitted over said one end of the shaft, said collar being unrotatable and axially moveable with respect to said shaft;

an elastic member arranged inside to elastically urge an axial end surface of said shaft; and a pair of bearings arranged between said receptacle portion of the cylinder block and said collar, one of said bearings being brought into contact with an axial end surface of said collar, another of said bearings being brought into contact with a peripheral side surface of said collar.

7. A compressor as claimed in claim 6, further comprising a pair of bearings arranged between said receptacle portion of the cylinder block and said collar, one of said bearings being brought into contact with an axial end surface of said collar, another of said bearings being brought into contact with a peripheral side surface of said collar.

8. A compressor comprising:

a cylinder block having a receptacle portion;

a shaft extending in an axial direction and having one end inserted into said receptacle portion;

a collar fitted over said one end of the shaft, said collar being unrotatable and axially moveable with respect to said shaft; and an elastic member arranged inside to elastically urge an axial end surface of said shaft, wherein said one end of the shaft has an outer peripheral surface provided with ridges and grooves extending in said axial direction, said collar having an inner peripheral surface provided with ridges and grooves extending in said axial direction, said inner peripheral surface of the collar being fitted to an engaged with said outer peripheral surface of the shaft.

9. A compressor comprising:

a cylinder block having a plurality of cylinders; a plurality of single-headed pistons adapted to perform reciprocal movement within said cylinders, respectively; a front housing coupled to said cylinder block; a shaft supported by said cylinder block and said front housing;

a swash plate integrally fixed to said shaft;

a plurality of shoes each of which is interposed between said swash plate and each of the pistons;

a pair of radial bearings arranged in said front housing and said cylinder block, respectively, to radially support said shaft;

a thrust race bearing arranged between said front housing and said swash plate;

a spring for urging an axial end surface of said shaft towards said front housing; and an interposed member interposed between said spring and said axial end surface of the shaft, said cylinder block having a stepped portion which serves to receive said spring abutted thereto so that said shaft is axially supported.

10. A compressor as claimed in claim 9, wherein said interposed member comprises an adjusting plate interposed between said axial end surface of the shaft and said spring.

11. A compressor as claimed in claim 9, wherein said interposed member comprises a thrust race bearing interposed between said axial end surface of the shaft and said spring.

* * * * *